US006854156B2

(12) United States Patent
Albert et al.

(10) Patent No.: US 6,854,156 B2
(45) Date of Patent: Feb. 15, 2005

(54) HANDLE FOR A VACUUM CLEANER

(75) Inventors: Wilma Albert, Wülfershausen (DE); Martin Jessenberger, Eussenhausen (DE); Herbert Kess, Bad Neustadt (DE); Andreas Schlereth, Bad Neustadt (DE); Thomas Seith, Bad Neustadt (DE)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 0 days.

(21) Appl. No.: 10/436,398

(22) Filed: May 12, 2003

(65) Prior Publication Data

US 2003/0217433 A1 Nov. 27, 2003

Related U.S. Application Data

(63) Continuation of application No. PCT/EP01/12836, filed on Nov. 6, 2001.

(30) Foreign Application Priority Data

Nov. 10, 2000 (DE) ..... 100 55 912

(51) Int. Cl.[7] ..... A47L 9/32

(52) U.S. Cl. ..... 15/323

(58) Field of Search ..... 15/323, 414, 415.1

(56) References Cited

U.S. PATENT DOCUMENTS 4,720,890 A 1/1988 Jacob

FOREIGN PATENT DOCUMENTS

| | | | |
|---|---|---|---|
| EP | 0 304 963 A1 | | 3/1989 |
| EP | 0 747 000 | * | 12/1996 |
| GB | 2 388 526 | * | 11/2003 |
| JP | 11-99099 | * | 4/1999 |
| JP | 11-285463 | | 10/1999 |
| JP | 11-318775 | * | 11/1999 |
| JP | 2000-70188 | * | 3/2000 |
| KR | 2002 0000265 | * | 1/2002 |
| WO | WO 03/000103 | * | 1/2003 |

* cited by examiner

*Primary Examiner*—Terrence R. Till
(74) *Attorney, Agent, or Firm*—Laurence A. Greenberg; Werner H. Stemer; Ralph E. Locher

(57) ABSTRACT

A handle for a vacuum cleaner is attached to a suction tube and/or a suction hose and is configured as a tube, which is open at one end, for storing an accessory that is fastened therein in captive manner and that can be removed.

18 Claims, 1 Drawing Sheet

HANDLE FOR A VACUUM CLEANER

CROSS-REFERENCE TO RELATED APPLICATION

This application is a continuation of copending International Application No. PCT/EP01/12836, filed Nov. 6, 2001, which designated the United States and was not published in English.

BACKGROUND OF THE INVENTION

FIELD OF THE INVENTION

The invention relates to a handle for a vacuum cleaner with a mounting device open to one side for receiving an accessory.

A vacuum cleaner handle is disclosed in European Patent Application 0 304 963 A1, corresponding to U.S. Pat. No. 4,720,890 to Jacob. In Jacob, which has a device for mounting of vacuum cleaner accessories, in particular, a connecting nozzle with a peripheral mounting open to one side for the connecting nozzle. The mounting is, thereby, preferably located beneath the handle, whereby, the lower edge of the mounting device runs substantially flush with the lower edge of a handle section of the handle.

SUMMARY OF THE INVENTION

It is accordingly an object of the invention to provide a handle for a vacuum cleaner that overcomes the hereinaforementioned disadvantages of the heretofore-known devices of this general type and that improves upon prior art vacuum cleaner handles and allows accessories to be stored in a simple manner and to be easily removable.

With the foregoing and other objects in view, there is provided, in accordance with the invention, a handle for a vacuum cleaner, including a mounting device being formed as a tube and having a front side, the tube being open on at least the front side for receiving an accessory therein, the mounting device to be connected at an acute angle to a suction tube or a suction hose of a vacuum cleaner.

With the objects of the invention in view, in a vacuum cleaner having an accessory, a suction tube, and a suction hose, there is also provided a holding device including a handle having a mounting device formed as a tube with a front side, the tube being open on at least the front side for receiving the accessory, the handle being connected at an acute angle to at least one of the suction tube and the suction hose With the objects of the invention in view, in a vacuum cleaner having an accessory, a suction tube, and a suction hose, there is also provided a holding device including a handle holding at least a first portion of the suction tube, the handle being connected at an acute angle to at least one of a second portion of the suction tube and the suction hose, and the handle being formed as an at least partially hollow tube having a front side and an integral hollow mounting device open to the front side for receiving an accessory therein.

By such a construction of the handle, a more compact structure is produced, which stores accessories in a space-saving manner, the accessories being quickly available to the hand of the user when the surface to be vacuumed or its geometry changes and the use of a particular nozzle, for example, an upholstery nozzle, is necessary.

In accordance with another feature of the invention, the mounting device has a longitudinal axis and a preponderance of a length of the accessory is to be inserted into the mounting device in a direction of the longitudinal axis.

In accordance with a further feature of the invention, the handle is a tube open at the front side, in which the accessory is insertable in the direction of the longitudinal axis of the handle. Alternatively, the accessory also is removed through an opening in the cover side of the tube from the handle or inserted therein. As far as multiple accessories having space in the handle, for example, different openings can be provided in the longitudinal side of the handle from which the accessories are removable or one of which is removable through the front side opening.

In accordance with an added feature of the invention, one form of the handle is advantageous, in which the accessory is clamped in the mounting device or locked therein. Corresponding connecting strips or latching seams serve this purpose, which, for example, are compressible against the reflecting force of a compression spring and engaged in the locked condition in a corresponding groove of the counterpiece. The removal of the accessory from the front side opening is facilitated thereby, in that, the cover wall of the handle has recesses, which connect to the open front side. In the region of these recesses, the accessories can be gripped with the hand and pulled from the tube. The removal of the accessory is, likewise, facilitated, in that, the tube of the handle encompasses the accessory only partially so that the handle projects from the tube at its end and, therefore, can be easily gripped.

In accordance with an additional feature of the invention, the handle or mounting device has a cover wall and the cover wall has at least one recess.

In accordance with yet another feature of the invention, the at least one recess connects to the open front side.

In accordance with yet a further feature of the invention, the handle or mounting device only partially surrounds the accessory.

In accordance with yet an added feature of the invention, particularly advantageous, likewise, is when the handle or mounting device is formed as an extension of the suction tube.

In accordance with yet an additional feature of the invention, the handle or mounting device has a free end, a diameter, and a connecting piece on the free end, and the connecting piece has a diameter greater than the diameter of the handle or mounting device.

In accordance with a concomitant feature of the invention, the handle or mounting device has a free end and is quiver-shaped and continually widens in the manner of a truncated cone to the free end.

Other features that are considered as characteristic for the invention are set forth in the appended claims.

Although the invention is illustrated and described herein as embodied in a handle for a vacuum cleaner, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
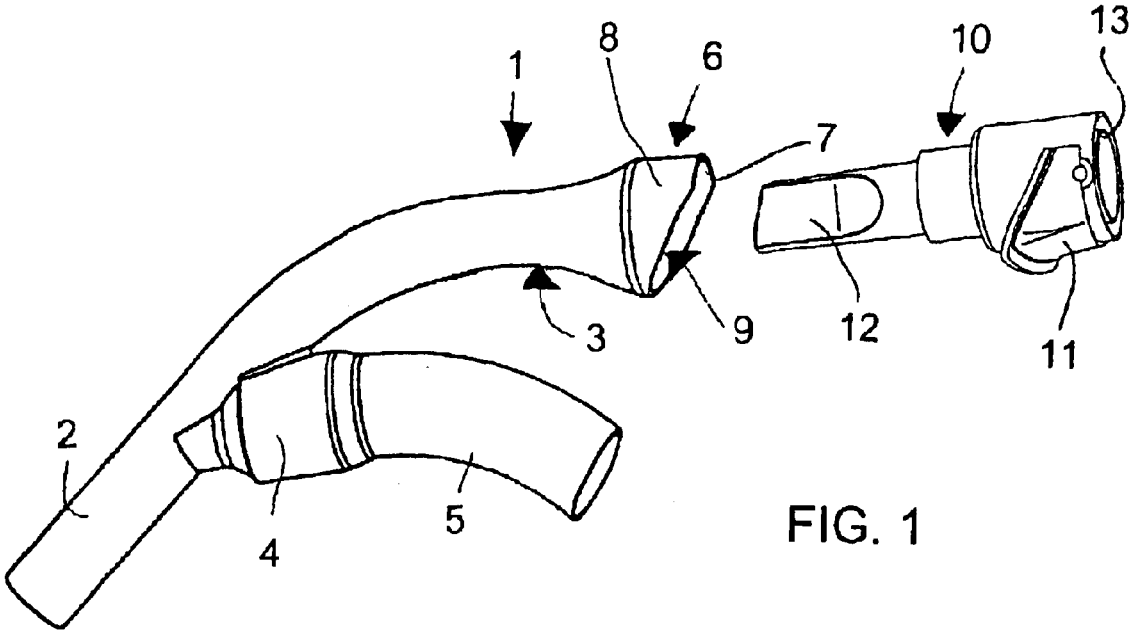
FIG. 1 is a fragmentary, exploded, perspective view of a handle and an accessory according to the invention.
Figure 2:
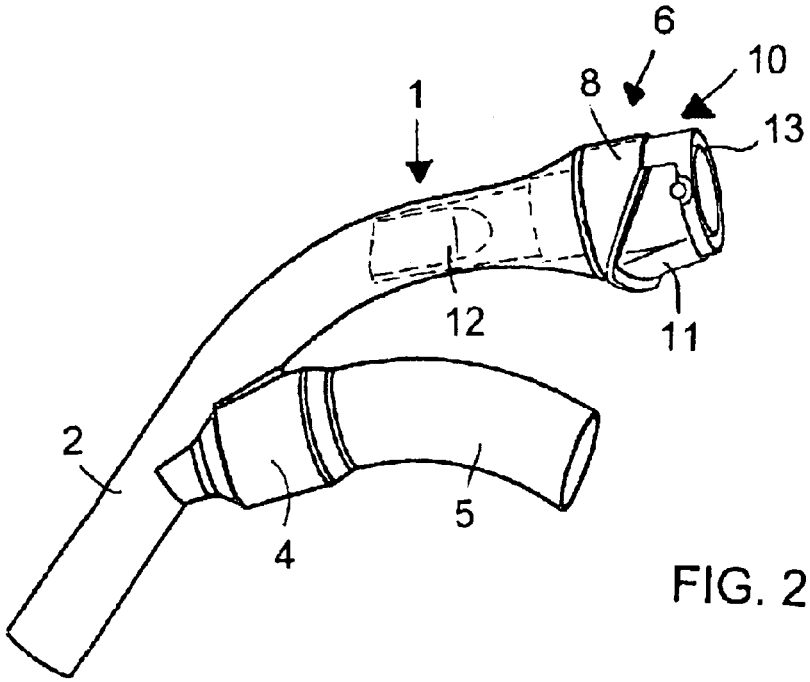
FIG. 2 is a fragmentary and partially hidden perspective view of the handle of FIG. 1 with the accessory inserted therein.

Referring now to the figures of the drawings in detail and, particularly, to FIGS. 1 and 2 thereof, there is shown a handle 1 is disposed on the end of a vacuum cleaner suction tube 2; therefore, it is formed as an extension of the suction tube 2. The suction tube 2, for example, is a telescoping tube. The handle 1 is, preferably, curved relative to the suction tube 2, so that it permits an ergonomically simple handling for the user. Advantageously, it has a gripping hollow 3. A connecting adapter 4 is mounted on the suction tube 2, which serves for receiving an end of a suction hose 5. Opposite the handle 1, the suction tube 2 is hermetically closed so that the suction airflow from the suction tube 2 flows completely into the suction hose 5.

The handle 1 has a connecting piece 6 on its free end, the connecting piece 6 being open on its front side, and additionally in the region of its cover side 8, has a recess 9 that converges to the open front side 7. The handle 1 holds an accessory 10 over the front side, which, for example, forms a combination of a furniture nozzle 11, a connecting nozzle 12, and a suction brush 13. Alternatively, also corresponding individual parts can be accommodated in the handle 1.

The accessory 10 is inserted into the handle 1 as illustrated in FIG. 2. Thereby, it projects, preferably, partially from the handle 1 so that it can be easily removed. The simple removability of the accessory 10 is also supported in that the recess 9 is provided to facilitate gripping of the accessory. To prevent the accessory 10 from falling out of the handle 1, preferably, a locking device is provided in the handle, for example, in the form of a non-illustrated locking detent, which corresponds with a complementary recess in the accessory 10. Alternatively, a non-illustrated connecting strip is disposed in the handle 1, by which the accessory 10 is engaged irremovably in the handle 1. The attachment of the accessory 10 can be achieved with other, non-illustrated embodiments, also by twisting, for example.

The handle 1 is either formed substantially cylindrically, or it has, in addition, a connecting piece 6 having a larger diameter, or it is quiver-shaped and widens continually like a truncated cone.

We claim:

1. A handle for a vacuum cleaner, comprising:

a mounting device being formed as a tube and having a front side and a free end, said mounting device being quiver-shaped and continually widening in the manner of a truncated cone to said free end, said tube being open on at least said front side for receiving an accessory therein, said mounting device to be connected at an acute angle to a suction tube or a suction hose of a vacuum cleaner.

2. The handle according to claim 1, wherein:

said mounting device has a longitudinal axis; and a preponderance of a length of the accessory is to be inserted into said mounting device in a direction of said longitudinal axis.

3. The handle according to claim 1, wherein the accessory is to be clamped or locked in said mounting device.

4. The handle according to claim 1, wherein said mounting device has a cover wall and said cover wall has at least one recess.

5. The handle according to claim 4, wherein said at least one recess connects to said open front side.

6. The handle according to claim 1, wherein said mounting device only partially surrounds the accessory.

7. The handle according to claim 1, wherein said mounting device is formed as an extension of the suction tube.

8. The handle according to claim 1, wherein said mounting device has a free end, a diameter, and a connecting piece on said free end, and said connecting piece has a diameter greater than said diameter of said mounting device.

9. In a vacuum cleaner having an accessory, a suction tube, and a suction hose, a holding device comprising:

a handle having a mounting device formed as a tube with a front side and a free end, said mounting device being quiver-shaped, and continually widening in the manner of a truncated cone to said free end, said tube being open on at least said front wide for receiving the accessory, said handle being connected at an acute angle to at least one of the suction tube and the suction hose.

10. In a vacuum cleaner having an accessory, a suction tube, and a suction hose, a holding device comprising:

a handle holding at least a first portion of the suction tube;

said handle being connected at an acute angle to at least one of a second portion of the suction tube and the suction hose; and said handle being formed as an at least partially hollow tube having:

a front aide and a free end, said handle being quiver-shaped and continually widening in the manner of a to said free end; and an integral hollow mounting device open to said front side for receiving an accessory therein.

11. The holding device according to claim 10, wherein:

said handle has a longitudinal axis; and a preponderance of a length of the accessory i.e. to be inserted into said mounting device in a direction of said longitudinal axis.

12. The holding device according to claim 10, wherein the accessory is clamped or locked in said handle.

13. The holding device according to claim 10, wherein said handle has a cover wall and said cover wall has at least one recess.

14. The holding device according to claim 13, wherein said at least one recess connects to said open front side.

15. The holding device according to claim 10, wherein said handle only partially surrounds the accessory.

16. The holding device according to claim 10, wherein said handle is formed as an extension of the suction tube.

17. The holding device according to claim 10, wherein said handle is an extension of the first portion of the suction tube.

18. The holding device according to claim 10, wherein said handle has a free end, a diameter, and a connecting piece on said free end, and said connecting piece has a diameter greater than said diameter of said handle.

* * * * *